US012320086B2

(12) United States Patent
Jager et al.

(10) Patent No.: US 12,320,086 B2
(45) Date of Patent: Jun. 3, 2025

(54) SNOWTHROWER AUGER HOUSING WITH RESILIENT SCRAPER

(71) Applicant: THE TORO COMPANY, Bloomington, MN (US)

(72) Inventors: Michael C. Jager, Bloomington, MN (US); Timothy J. Clift, Lino Lakes, MN (US)

(73) Assignee: THE TORO COMPANY, Bloomington, MN (US)

( * ) Notice: Subject to any disclaimer, the term of this patent is extended or adjusted under 35 U.S.C. 154(b) by 696 days.

(21) Appl. No.: 17/544,082

(22) Filed: Dec. 7, 2021

(65) Prior Publication Data

US 2022/0205201 A1 Jun. 30, 2022

Related U.S. Application Data

(60) Provisional application No. 63/131,148, filed on Dec. 28, 2020.

(51) Int. Cl.
*E01H 5/06* (2006.01)
*E01H 5/09* (2006.01)

(52) U.S. Cl.
CPC ..... *E01H 5/098* (2013.01); *E01H 5/061* (2013.01)

(58) Field of Classification Search
CPC ..... E01H 5/098; E01H 5/061; E01H 5/066; E01H 5/045; E01H 5/12; E01H 5/04; E01H 5/062
See application file for complete search history.

(56) References Cited

U.S. PATENT DOCUMENTS

| | | | | |
|---|---|---|---|---|
| 5,079,866 | A | 1/1992 | Farrell | |
| 5,410,825 | A * | 5/1995 | Perrelli | E01H 5/062 37/232 |
| 5,437,113 | A | 8/1995 | Jones | |
| 5,697,172 | A | 12/1997 | Verseef | |
| 6,354,025 | B1 | 3/2002 | Kirchell | |
| 7,137,214 | B2 * | 11/2006 | Hoerle | E01H 5/04 37/244 |
| 7,437,839 | B2 | 10/2008 | Christy et al. | |
| 7,743,536 | B2 | 6/2010 | Evans et al. | |
| 8,047,310 | B2 | 11/2011 | Kallevig | |
| 9,051,700 | B2 | 6/2015 | Summers et al. | |
| 2004/0006895 | A1 | 1/2004 | Schultz et al. | |
| 2012/0279093 | A1 * | 11/2012 | Niemela | E01H 5/061 37/242 |
| 2014/0196323 | A1 * | 7/2014 | Bullington | E01H 5/098 37/257 |

(Continued)

OTHER PUBLICATIONS

Jager et al., U.S. Appl. No. 63/131,148, filed Dec. 28, 2020.

(Continued)

*Primary Examiner* — Adam J Behrens
*Assistant Examiner* — Robert E Pezzuto
(74) *Attorney, Agent, or Firm* — Mueting Raasch Group

(57) ABSTRACT

A snowthrower comprising an auger housing incorporating a resilient scraper attached to a lower edge of a rear wall of the housing. The scraper is configured to permit effective scraping of snow at the ground surface, while reducing damage to the housing that may otherwise result from traversal of the housing over obstacles such as handhole and manway covers during snowthrower operation.

6 Claims, 6 Drawing Sheets

(56) References Cited

U.S. PATENT DOCUMENTS

2015/0068074 A1* 3/2015 Mast ..... E01H 5/098
37/197

OTHER PUBLICATIONS

"SG Snowplow" Web page [online]. [retrieved on Oct. 27, 2022]. Retrieved from the Internet: URL: https://web.archive.org/web/20200923183049/https://www.steelgreenmfg.com/equipments/sg-snowplow/. Steel Green Manufacturing, page dated (by archive.org) Sep. 9, 2020, Copyright 2020, 2 pages.

"The Z-Plow" Web page [online]. [retrieved on Oct. 27, 2022]. Retrieved from the Internet: URL: https://web.archive.org/web/20201024123123/https://www.z-plow.com/. Steel Green Manufacturing, page dated (by archive.org) Oct. 24, 2020, 3 pages.

* cited by examiner

SNOWTHROWER AUGER HOUSING WITH RESILIENT SCRAPER

This application claims priority to and/or the benefit of U.S. Provisional Application No. 63/131,148, filed Dec. 28, 2020, which is incorporated herein by reference in its entirety.

Embodiments of the present disclosure relate to snowthrowers and, more particularly, to an auger housing and resilient ground surface scraper for use with the same.

BACKGROUND

Snowthrowers are known for clearing snow from ground surfaces such as driveways and walkways. Such machines typically fall into one of two categories: single-stage; and multi-stage. An example of the latter is a two-stage snowthrower that includes a rigid helical auger (first stage) extending transversely across an auger housing, the housing having a front-facing collection opening. Snow is collected in the auger housing as the snowthrower moves forwardly, wherein the auger cuts the snow and moves it transversely toward a discharge area. Once the snow reaches the discharge area, a high-speed impeller (second stage) ejects the snow outwardly away through a directional discharge chute. Wheels or other powered propulsion members are typically included to propel the snowthrower over the ground surface during snowthrower operation.

Conversely, single-stage snowthrowers typically achieve both snow collection and ejection using a single, horizontally-extending high-speed auger. Single-stage snowthrowers generally lack a dedicated propulsion system, although some may utilize ground contact of the high-speed auger to assist with snowthrower propulsion.

SUMMARY

Embodiments described herein may provide a snowthrower including an auger housing having spaced-apart first and second sidewalls connected to one another by a rear wall to define a front-facing collection opening, wherein the rear wall includes a lower edge. The snowthrower further includes: an auger positioned within the auger housing between the collection opening and the rear wall; and a resilient scraper connected to the lower edge of the rear wall, the resilient scraper extending downwardly from the rear wall toward a ground surface.

In another embodiment, a snowthrower is provided that includes an auger housing again having spaced-apart first and second sidewalls connected to one another by a rear wall to define a front-facing collection opening, wherein the rear wall includes a lower edge. The auger housing may be supported upon a ground surface at least partially by first and second skids attached to the first and second sidewalls, respectively. The snowthrower further includes an auger positioned within the auger housing between the collection opening and the rear wall. The auger includes an auger shaft having first and second end portions terminating at or near the first and second sidewalls, respectively, wherein the auger shaft defines an auger axis intersecting the sidewalls. The auger shaft is configured to rotate, relative to the auger housing, about the auger axis. The auger further includes at least one flight attached to, and radially spaced-apart from, the auger shaft. A resilient scraper is also provided and forms a cantilever having an upper end connected to the lower edge of the rear wall, wherein the resilient scraper extends downwardly toward the ground surface to terminate at a lower end.

In still another embodiment, a self-propelled snowthrower vehicle is provided that includes a chassis having a front end and a rear end, the rear end spaced-apart from the front end along a longitudinal axis of the vehicle. The chassis may further include a control tower extending upwardly at or near the rear end. The vehicle further includes: ground-engaging members adapted to support a portion of the chassis upon a ground surface; a support platform attached to the chassis at or near the rear end and configured to support an operator; and a snowthrower attached to the chassis. The snowthrower includes: an auger housing having spaced-apart first and second sidewalls connected to one another by a rear wall to define a front-facing collection opening, the rear wall comprising a lower edge; an auger positioned within the auger housing between the collection opening and the rear wall; and a resilient scraper attached to the lower edge of the rear wall, the resilient scraper extending downwardly from the rear wall toward the ground surface.

The above summary is not intended to describe each embodiment or every implementation. Rather, a more complete understanding of illustrative embodiments will become apparent and appreciated by reference to the following Detailed Description of Exemplary Embodiments and claims in view of the accompanying figures of the drawing.

BRIEF DESCRIPTION OF THE VIEWS OF THE DRAWING

Exemplary embodiments are described with reference to the figures of the drawing, wherein.

Figure 1:
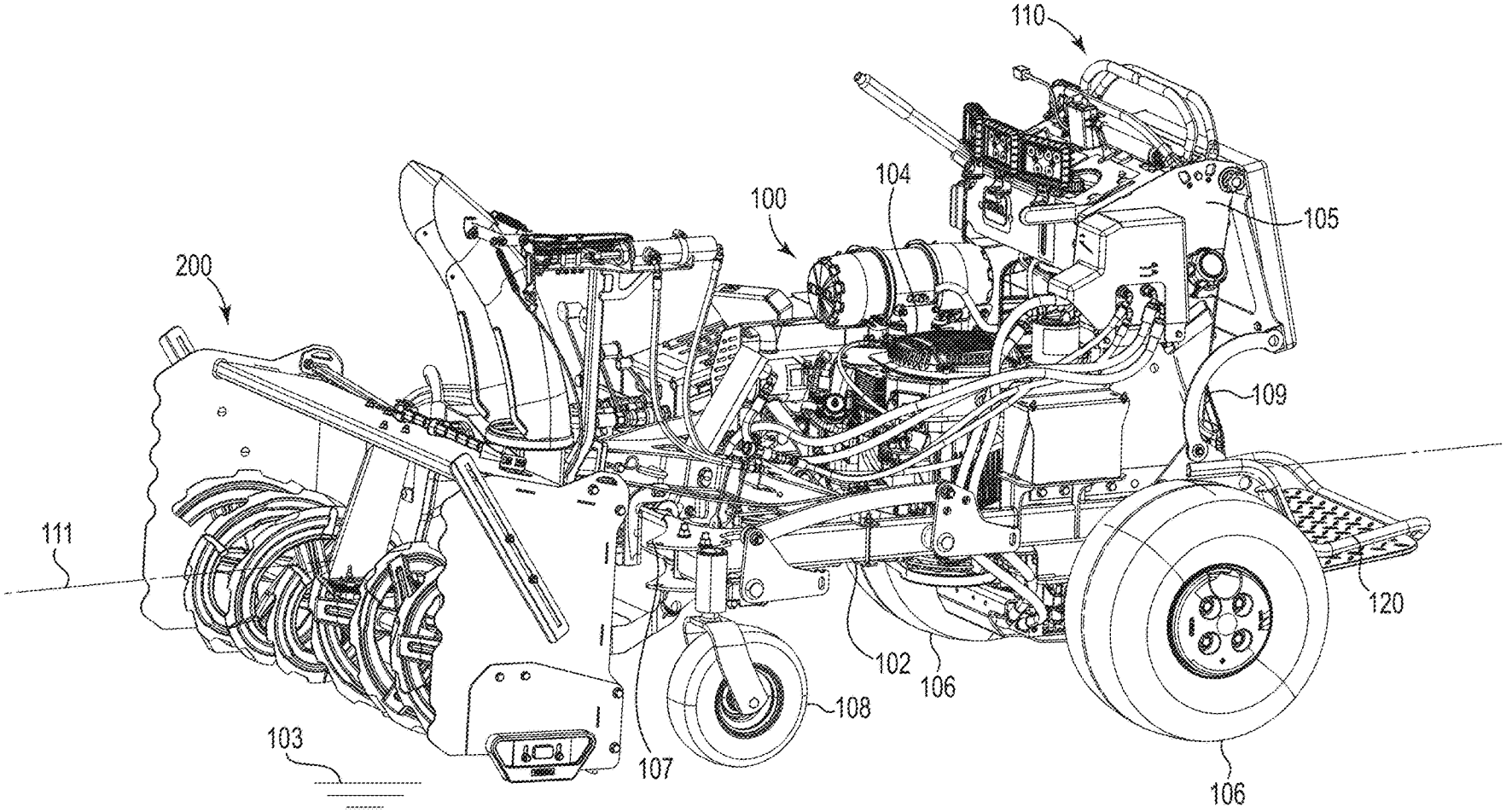
FIG. 1 is a left front perspective view of a snowthrower vehicle incorporating an implement (e.g., snowthrower) in accordance with embodiments of the present disclosure.

The figures are rendered primarily for clarity and, as a result, are not necessarily drawn to scale. Moreover, various structure/components, including but not limited to fasteners, electrical components (wiring, cables, etc.), and the like, may be shown diagrammatically or removed from some or all of the views to better illustrate aspects of the depicted embodiments, or where inclusion of such structure/components is not necessary to an understanding of the various exemplary embodiments described herein. The lack of illustration/description of such structure/components in a particular figure is, however, not to be interpreted as limiting the scope of the various embodiments in any way.

DETAILED DESCRIPTION OF EXEMPLARY EMBODIMENTS

In the following detailed description of illustrative embodiments, reference is made to the accompanying figures of the drawing which form a part hereof. It is to be understood that other embodiments, which may not be described and/or illustrated herein, are certainly contemplated.

All headings presented are for the convenience of the reader and should not be used to limit the meaning of any text that follows the heading, unless so specified. Moreover, unless otherwise indicated, all numbers expressing quantities, and all terms expressing direction/orientation (e.g., vertical, horizontal, parallel, perpendicular, etc.) in the specification and claims are to be understood as being modified by the term "about." The term "and/or" (if used) means one or all of the listed elements or a combination of any two or more of the listed elements. The term "i.e." is used as an abbreviation for the Latin phrase id est and means "that is." The term "e.g." is used as an abbreviation for the Latin phrase exempli gratia and means "for example."

In general, embodiments of the present disclosure relate to snowthrowers and to vehicles incorporating the same. Such snowthrowers may include a rigid (e.g., metal) auger housing having spaced-apart first and second sidewalls connected to one another by a rear wall to define a front-facing collection opening, wherein the rear wall includes a lower edge. An auger or auger assembly may be positioned within the auger housing between the collection opening and the rear wall. Snowthrowers in accordance with embodiments of the present disclosure may also include a resilient scraper attached to the lower edge of the rear wall. The resilient scraper may extend downwardly from the rear wall toward a ground surface upon which the snowthrower operates.

During snowthrower operation, various obstacles may be encountered. For instance, utility covers such as handhole and manway covers may protrude (e.g., due to frost heave) above the surrounding ground surface. These generally immovable obstacles, which may be difficult for an operator to detect beneath snow, can cause damage to the auger housing should the obstacle be of sufficient height to catch on the lower edge of the rear wall. This potential for damage is elevated in commercial/contract operator settings due to, for example, operator unfamiliarity with the presence of such obstacles on the property, and potentially higher ground speed snowthrower operation often associated with commercial usage.

To address this problem, embodiments of the present disclosure may provide a resilient lip or scraper extending along the transverse lower edge of the rear wall of the auger housing. As a result, instead of contact with the rigid auger housing, elevated obstacles may instead contact the resilient scraper, which may then deflect sufficiently to ride up and over the obstacle as further described below.

In the following description, the resilient scraper may be described as a component separate from the remainder of the auger housing. Such a distinction is for simplicity of description, however, as the scraper may also be considered to be part (e.g., form the ultimate lower edge) of the auger housing itself.

The term "resilient" may be used herein to describe a member or material having the ability to elastically recover to its initial size and shape after deformation (e.g., after deflecting, bending, compressing, stretching). Examples of resilient materials include, but are not limited to, elastomers such as rubber (natural and synthetic), silicone, and polyurethane.

It is noted that the terms "have," "include," "comprise," and variations thereof, do not have a limiting meaning, and are used in their open-ended sense to generally mean "including, but not limited to," where the terms appear in the accompanying description and claims. Further, "a," "an," "the," "at least one," and "one or more" are used interchangeably herein. Moreover, relative terms such as "left," "right," "front," "fore," "forward," "rear," "aft," "rearward," "top," "bottom," "side," "upper," "lower," "above," "below," "horizontal," "vertical," and the like may be used herein and, if so, are from the perspective shown in the particular figure, or while the vehicle 100/snowthrower 200 is in an operating configuration (e.g., while the vehicle 100 is positioned such that wheels 106 and 108 rest upon a generally horizontal ground surface 103 as shown in FIG. 1). These terms are used only to simplify the description, however, and not to limit the interpretation of any embodiment described.

With reference to the figures of the drawing, wherein like reference numerals designate like parts and assemblies throughout the several views, FIG. 1 illustrates an exemplary self-propelled snowthrower vehicle 100 including an implement (e.g., snowthrower 200) attached to a front end 107 of the vehicle. While the general construction of the vehicle 100 is not necessarily central to an understanding of embodiments of the snowthrower 200, an exemplary vehicle is now briefly described.

The vehicle 100 may include a traction frame or chassis 102 supporting a prime mover, e.g., internal combustion engine 104 or electric motor. A pair of ground-engaging members (e.g., first (left) and second (right) drive wheels 106) may be coupled for rotation, respectively, to the left and right rear sides of the chassis to support and propel the vehicle 100 relative to the ground surface 103. A transmission (not shown) may be configured to power one or both of the first and second drive wheels 106. In the illustrated embodiment, each drive wheel 106 may be powered by its own transmission (e.g., by its own hydrostatic motor and pump) powered by the engine 104. Other transmissions, e.g., mechanical gear- or pulley-driven systems, single or independent electric motors, etc. are also possible.

Operator controls 110 are provided and permit independent control of the speed and direction of each drive wheel 106, allowing control of vehicle speed and direction from a walking or riding (e.g., standing) position. A pair (e.g., left and right) of front caster wheels 108 (only left wheel 108 visible in FIG. 1), which may be connected to forwardly extending portions or rails of the chassis 102, may support the front of the vehicle 100 in rolling engagement with the ground surface 103.

Although the illustrated vehicle has the drive wheels 106 in the rear and caster wheels 108 in front, this configuration is not limiting. For example, other embodiments may reverse the location of the wheels, e.g., drive wheels in front and driven or undriven wheels in back, while other embodiments may replace the wheels with other members such as tracks or skis. Moreover, still other configurations may use different wheel configurations altogether, e.g., a tri-wheel configuration or a vehicle using conventionally steered (e.g., Ackermann-type) wheels. Accordingly, most any wheeled, tracked, or other configuration is contemplated.

The exemplary vehicle 100 may further include a support platform 120 attached to the chassis 102 at or near a rear end 109 thereof and configured to support a standing operator. In some embodiments, the platform may be moved between a deployed position as shown in FIG. 1, and a stowed position (not shown, but folded against the vehicle 100 like that shown in, e.g., FIG. 2 of U.S. Pat. No. 8,047,310). In the deployed position, an operator may stand upon the platform 120 during vehicle operation. Alternatively, the platform 120 may be moved to the stowed position to accommodate the operator in a walk-behind position. In still other embodiments, the vehicle could accommodate the operator in a sitting position, or could be configured strictly for a walk-behind operator. In still other embodiments, the vehicle may be autonomously or remotely controlled, potentially negating the need for any operator platform.

As further illustrated in FIG. 1, the vehicle 100 may also include the operator controls 110. In some embodiments, the controls are mounted to the chassis, e.g., to a control tower 105 extending upwardly at or near the rear end 109 of the vehicle/chassis (the rear end of the vehicle/chassis being spaced-apart from the front end 107 of the vehicle/chassis along a longitudinal axis 111), such that the operator controls are located within comfortable reach of an operator standing either behind the vehicle or upon the platform 120.

The snowthrower 200 (described in more detail below) may include an auger housing partially enclosing one or more helical augers as is known in the art. The auger(s) may be operatively powered by the engine 104 (e.g., mechanically or via a hydraulic system). That is, during operation, power is selectively delivered to the snowthrower 200, whereby the auger(s) rotate to collect snow, while a powered impeller ejects the collected snow through a discharge chute as also described below.

In some embodiments, the vehicle 100 may be a utility vehicle such as the GrandStand Multi Force model utility vehicle sold by The Toro Company of Bloomington, Minnesota, USA. Such a utility vehicle is adapted to receive a variety of different attachments such as snowthrowers, plow blades, lawn mower cutting decks, debris blowers, etc. However, most any snowthrower, including dedicated and non-dedicated snowthrower machines configured for ride-on, walk-behind, remote, or autonomous control are also contemplated within the scope of this disclosure.

Figure 2:
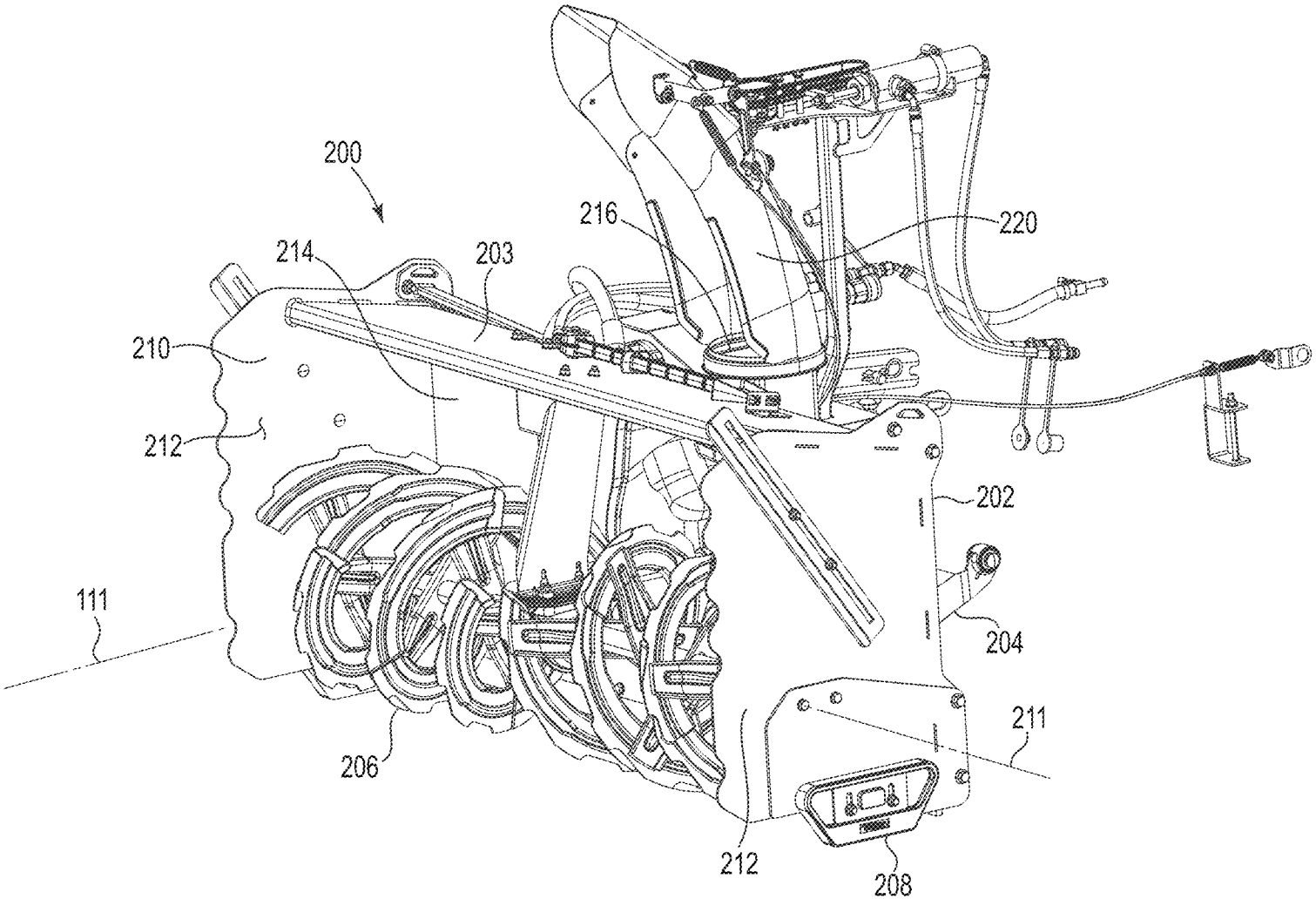
FIG. 2 is an isolated view of the snowthrower of FIG. 1.
Figure 3:
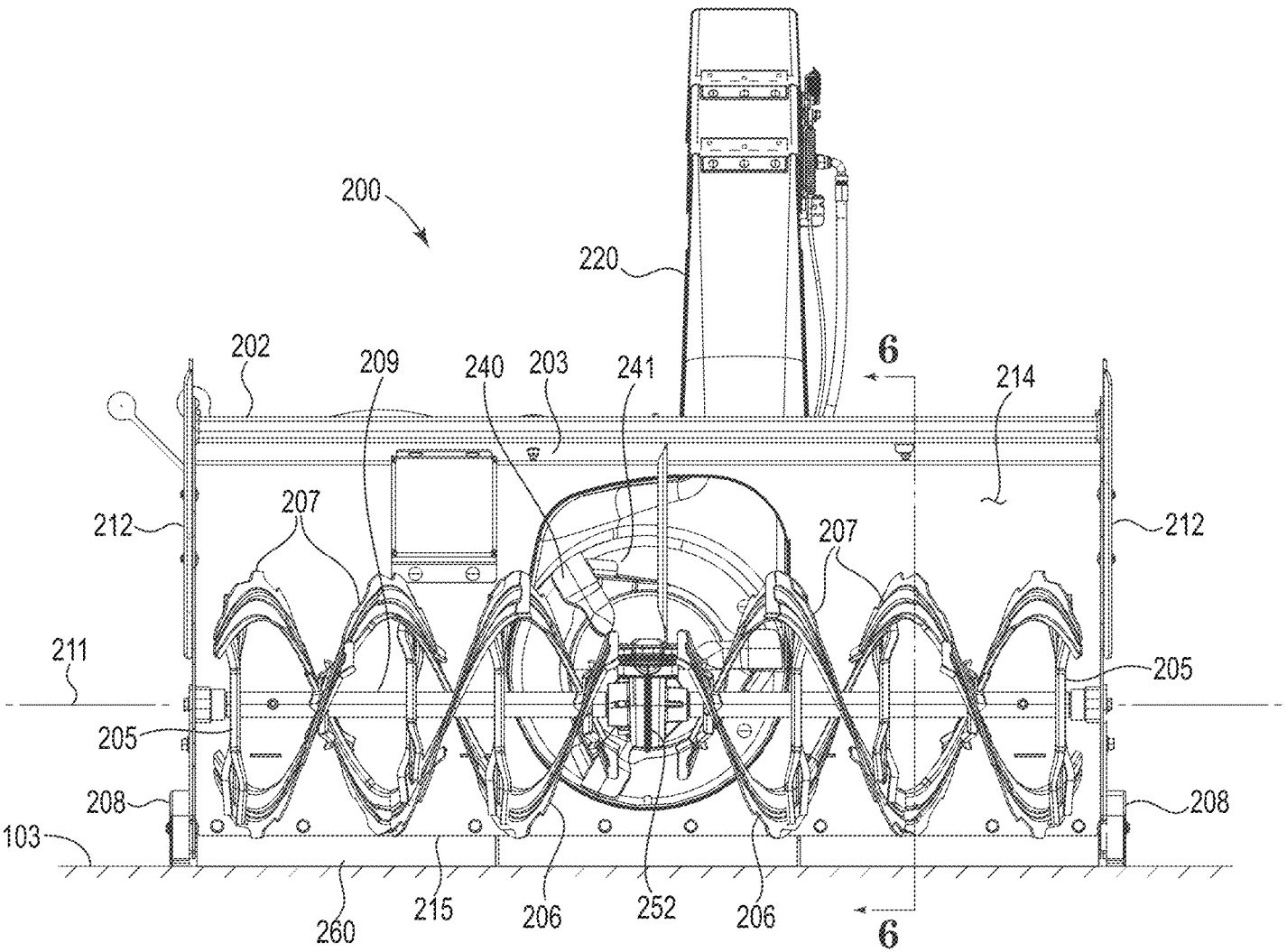
FIG. 3 is a front elevation view of the snowthrower of FIG. 2 illustrating a resilient scraper in accordance with embodiments of the present disclosure.
Figure 4:
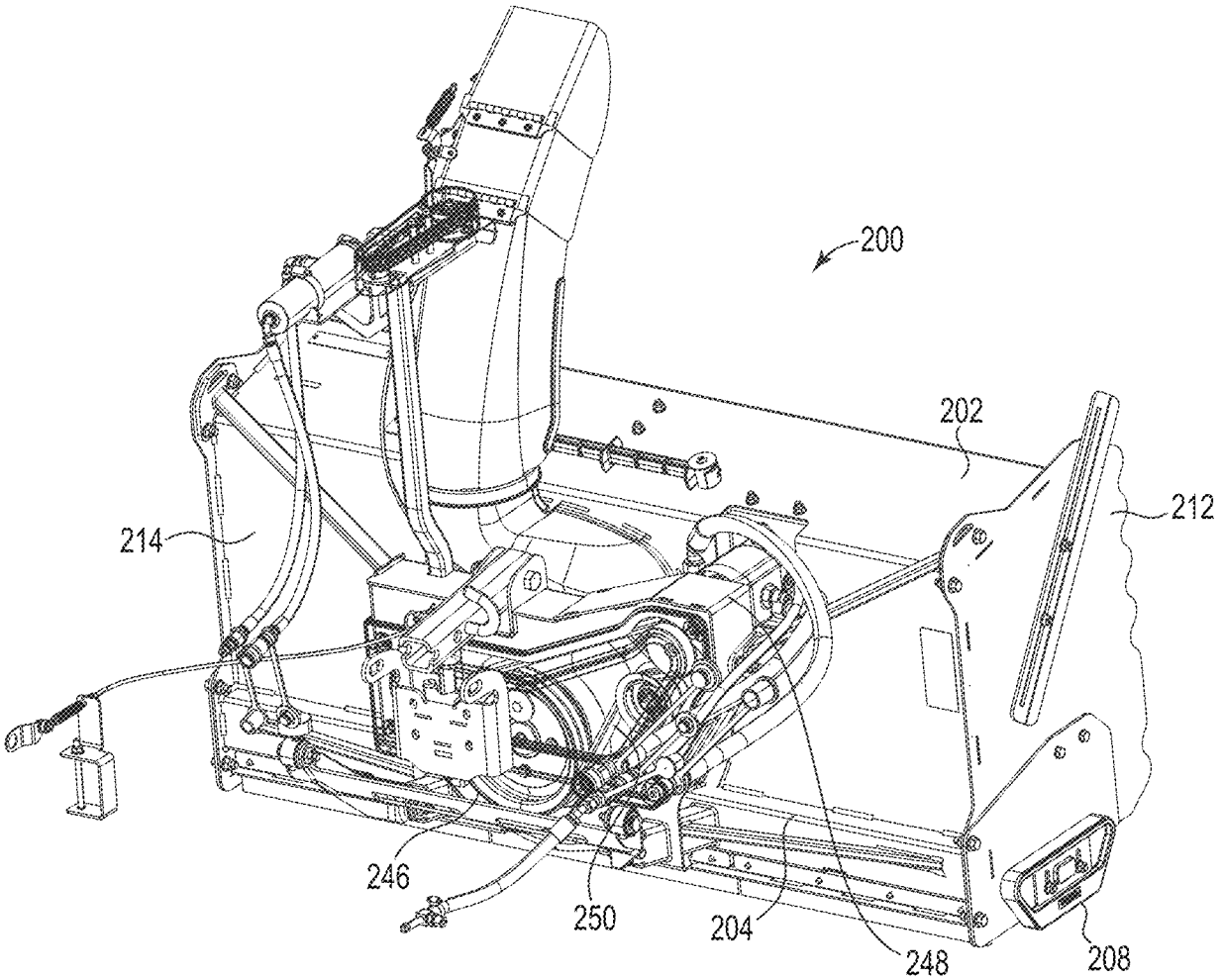
FIG. 4 is a right rear perspective view of the snowthrower of FIG. 2.

With reference to FIGS. 2-4, the general construction of the exemplary snowthrower 200 is now described. Once again, the snowthrower 200 may include an auger housing 202 having or attached to a support frame 204, wherein an auger 206 is positioned within the housing as shown. The auger 206 may be configured for rotating (e.g., via engine 104 power) within, and relative to, the housing 202. The housing 202 may define a partially enclosed volume such that the housing at least partially surrounds or encloses the auger 206. Lowermost portions of the housing 202 may include or otherwise define first and second skids 208 (one attached to each of a first and second sidewall 212) that support the housing upon the ground surface 103 during snowthrower operation.

The housing 202 may also include an upper wall 203 and a pair of spaced-apart sidewalls 212 connected to one another by a rear wall 214 such that the housing forms a front-facing collection opening 210 positioned forward of the auger 206. The auger may be positioned between the collection opening 210 and the rear wall 214 as shown in FIG. 2.

The auger may also include an auger shaft 209 having first and second end portions terminating at or near the first and second sidewalls 212, respectively, and defining an auger axis 211 intersecting the sidewalls such that the auger shaft is configured to rotate, relative to the auger housing, about the auger axis. The auger may also include at least one flight 207 (described below) attached to, and radially spaced-apart from, the auger shaft/auger axis, for example, by arms 205 (see FIG. 3).

As used herein, "longitudinal axis" or "longitudinal direction" refers to a long axis of the vehicle 100 or snowthrower 200, e.g., the centerline longitudinal axis 111 extending in the travel or fore-and-aft direction as shown in FIGS. 1 and 2. "Transverse" or "transverse axis" refers to a direction or axis extending side-to-side, e.g., a horizontal axis that is normal or transverse to a longitudinal axis of the vehicle/snowthrower such as the auger axis 211 shown in FIG. 3.

The housing 202 may also define a discharge opening or outlet 216 and a discharge chute 220. The discharge chute 220 may be operatively coupled to the housing 202 such that the discharge chute 220 fluidly communicates with the discharge outlet 216 so that snow within the housing 202 may be ejected through the discharge chute 220 (via the discharge outlet 216). The discharge chute 220 may be adapted to rotate about a chute axis and may include an adjustable deflector to direct snow exiting the discharge chute 220.

The auger 206 may be configured to rotate, relative to the housing 202, about the auger axis 211. A helix angle of the auger 206 may be configured to transport snow entering the collection opening 210 of the housing 202 towards the center of the housing. Specifically, the auger may include two (left and right) auger sections, wherein the helix angles and rotational direction of the auger sections transport snow captured between the sidewalls 212 and direct it towards the center of the collection opening 210.

Along the rear wall 214 near the center of the collection opening 210, the snow may enter an impeller chamber 241 (see FIG. 3) containing an impeller 240 (described below). The impeller 240 may then eject the snow outwardly through the discharge outlet 216/chute 220.

The impeller 240 may be operatively powered by the engine 104 to rotate about an axis that is parallel to the longitudinal axis 111 (see FIG. 2). For example, the impeller 240 may be coupled to a driven shaft that is connected to a sheave 246 powered by a hydraulic motor 248 (vial a belt 250) as indicated in FIG. 4 (the hydraulic motor 248, in turn, being powered by a hydraulic pump (not shown) attached to the vehicle and powered by the vehicle engine 104). The driven shaft may also operatively couple to an auger gear housing 252 (see FIG. 3) such that rotational motion from the motor 248 rotates both the impeller 240 and the auger 206 (via the auger shaft 209 and auger gear housing 252). The auger gear housing 252 may include a gear reduction system to slow the speed of rotation of the auger 206 relative to the impeller 240. Once again, the auger/impeller drive system illustrated in FIG. 4 is exemplary only, and other drive systems (e.g., separate motors for each of the impeller and auger, mechanical drives, electrical drives, etc.) are certainly contemplated.

Auger housings in accordance with embodiments of the present disclosure may also incorporate a resilient scraper 260 as shown in FIG. 3. The resilient scraper 260 may extend downwardly from a lower edge 215 of the rear wall 214 toward the ground surface 103 as shown. As stated elsewhere herein, the resilient scraper 260 allows the auger housing 202 to scrape snow close to the ground surface 103 during operation (for improved snow clearing) yet permit the housing to traverse protruding obstacles with less chance of undesirable obstacle/housing 202 contact.

Figure 5:
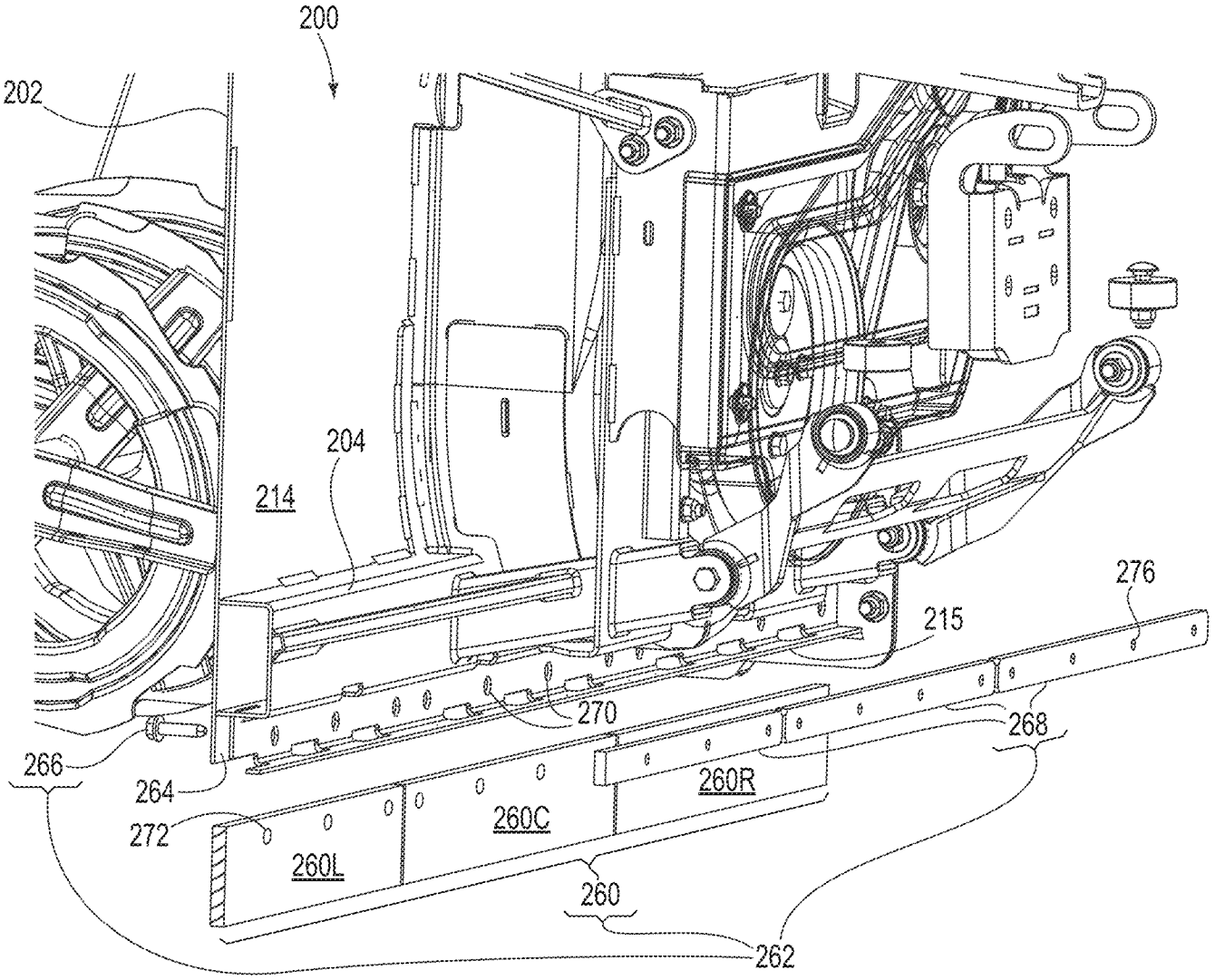
FIG. 5 is a partial perspective section view of the snowthrower of FIG. 2 with an exemplary scraper assembly (e.g., resilient scraper and scraper attachment components) exploded therefrom.

FIG. 5 is a partial perspective section view of the snowthrower 200/housing 202, the section taken along a plane normal to the auger axis 211 with the resilient scraper 260 shown exploded therefrom. As shown in this view, the resilient scraper 260 includes two or more separate scraper elements or segments (e.g., segments 260L, 260C, and 260R) such that the scraper extends along all or most of a length of the rear wall 214 (e.g., in the illustrated embodiments, the scraper extends a full width of the rear wall, terminating at or near each of the sidewalls 212 as shown in FIG. 3). In the illustrated embodiments, the scraper segments are aligned end-to-end such that each scraper segment extends along a different transverse portion of the rear wall.

While a single scraper element could be provided extending across the entire desired length, multiple segments may permit increased flexibility, resulting in more effective obstacle traversal. In yet other embodiments, a single segment spanning most or all of the desired length may be provided, but include one or more slits or cuts (e.g., slits vertical or perpendicular to the lower edge 215 of the rear wall) along the length of the scraper to provide similar deflection capabilities as a multi-segmented scraper.

As further shown in FIG. 5, the scraper 260 may form part of a scraper assembly 262 that further includes, in some embodiments: fasteners 266 (only one fastener shown in FIG. 5); and one or more retaining members 268. The lower edge 215 of the rear wall 214 may define a slot 264 into which the scraper 260 (e.g., segments 260L, 260C, and 260R) may be inserted (from below). The lower edge 215 may further define an aligned series of openings 270 passing through (and perpendicular to) the slot 264, where each of the series of openings 270 also aligns with a corresponding opening 272 and 276 defined in the scraper segments and the retaining members 268, respectively. Once the scraper segments are inserted into the slot 264 and its openings 272 aligned with the corresponding openings 270, one of the fasteners 266 is then passed through each set of aligned openings 270, 272, and 276 and secured. For instance, each of the openings 276 may receive its respective fastener 266 with an interference fit. Alternatively, each of the openings 276 may threadedly receive its respective fastener 266.

While shown using the fasteners 266 and retaining members 268, such a configuration is not limiting. In fact, most any configuration is contemplated that permits an upper end of the resilient scraper to connect (e.g., be secured relative) to the lower edge 215 of the rear wall 214 such that the resilient scraper forms a cantilever or cantilevered member having an unsupported lower end.

In some embodiments, the openings 272 of the resilient scraper 260 may be vertically elongated to permit vertical adjustment of the position of the resilient scraper. Such adjustment may be beneficial to, for example, change the effective cantilever length and/or ground clearance of the resilient scraper, or to adjust the scraper as wear occurs.

While not wishing to be bound to any specific material or material properties, the resilient scraper 260 (e.g., each of the segments 260L, 260C, and 260R), may in some embodiments, be formed of polyurethane sheet having a thickness of 0.2 to 0.5 inches (e.g., 0.38 inches) and a durometer of 70 to 90 Shore A (e.g., 80 Shore A). Such a configuration may provide sufficient thickness to scrape snow effectively, while providing the desired deformation properties to permit obstacle traversal.

Figure 6:
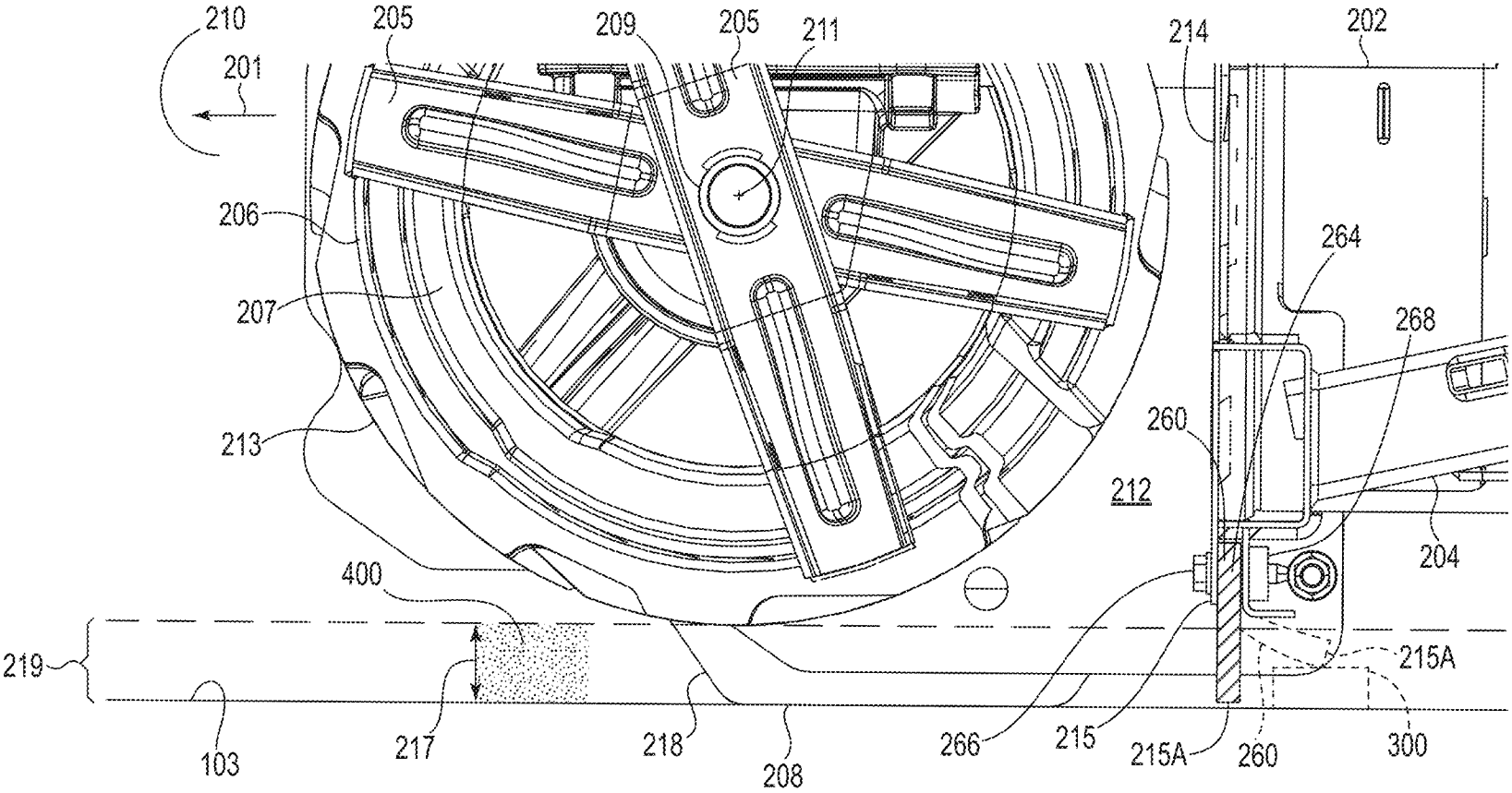
FIG. 6 is a section view taken along line 6-6 of FIG. 3.

FIG. 6 is cross section of the auger housing 202 taken along line 6-6 of FIG. 3. As shown in this view, the skids 208 may be vertically adjustable to locate the rigid auger 206 at a desired elevation above the ground surface 103 that permits the snowthrower 200 to traverse various ground surface undulations without auger contact with the ground surface, yet still providing desirable snow removal.

Each section (left and right) of the auger 206 may include one or more helical flights 207 connected to the auger shaft 209 by arms 205 such that the flights may rotate with the shaft. As the flights 207 rotate, they define a surface of revolution 213 about the auger axis 211, the surface of revolution 213 spaced-apart from the ground surface 103 (during normal snowthrower operation) by an auger offset distance 217. While not wishing to be bound to any particular geometry, the auger offset distance 217 may, in some embodiments, be 1 to 2 inches (e.g., 1.5 inches). The auger offset distance 217 may create an auger clearance zone 219 between the auger (surface of revolution 213) and the ground surface 103 as shown. Of course, the auger offset distance may vary, potentially significantly, depending on other parameters and ground surface conditions, as well as particular snowthrower geometry.

To ensure collection of snow located within the clearance zone 219, the resilient scraper 260 may be attached to the lower edge 215 of the rear wall 214 such that the resilient scraper extends downwardly from the rear wall toward the ground surface 103 (i.e., a lower end 215A of the resilient scraper extends downwardly into the auger clearance zone 219) as shown. In some embodiments, the lower end 215A of the resilient scraper 260 may extend downwardly to a position at or near the ground surface 103 as shown. Once the resilient scraper 260 is installed, the lower end 215A may effectively form the lower edge of the rear wall of the auger housing.

During snowthrower operation, the snowthrower may move forwardly (in the direction 201) such that snow enters the housing 202 through the collection opening 210. As snow enters the collection opening, the auger sections move the snow toward the impeller 240 (see FIG. 3), where it is then ejected through the discharge chute 220. As shown in FIG. 6, however, the clearance zone 219 created by the auger offset distance 217 leaves a layer of snow 400 intact below the auger. This layer of snow is, however, scraped by the resilient scraper 260, wherein it is directed upwardly along the rear wall 214 where it then contacts the auger 206 and is ultimately ejected through the discharge chute 220.

As stated elsewhere herein, an obstacle 300 (e.g., handhole, manway, etc.) may exist beneath the snow. Should the obstacle 300 impact either of the skids 208, a front ramp 218 of the skid (see FIG. 6) may permit the auger housing 202 to ride up and over the obstacle. Should the obstacle 300 instead pass between the skids 208, however, it may ultimately encounter the resilient scraper 260 (rather than the rigid rear wall 214). When this occurs, the scraper may deflect (see broken line scraper 260 in FIG. 6) to permit passage of the obstacle 300. Once the obstacle is clear, the scraper may elastically return to its generally vertical, undeflected position (see solid line scraper in FIG. 6).

Snowthrowers in accordance with embodiments of the present disclosure may thus allow traversal of various ground obstacles without damage that could otherwise occur using a conventional snowthrower with a more rigid scraper edge.

The complete disclosure of the patents, patent documents, and publications cited herein are incorporated by reference in their entirety as if each were individually incorporated. In the event that any inconsistency exists between the disclosure of the present application and the disclosure(s) of any document incorporated herein by reference, the disclosure of the present application shall govern.

Illustrative embodiments are described and reference has been made to possible variations of the same. These and other variations, combinations, and modifications will be apparent to those skilled in the art, and it should be understood that the claims are not limited to the illustrative embodiments set forth herein.

What is claimed is:

1. A snowthrower comprising:

an auger housing comprising spaced-apart first and second sidewalls connected to one another by a rear wall to define a front-facing collection opening, the rear wall comprising a lower edge, wherein the auger housing is supported upon a ground surface at least partially by first and second skids attached to the first and second sidewalls, respectively;

an auger positioned within the auger housing between the collection opening and the rear wall, the auger comprising:

an auger shaft comprising first and second end portions terminating at or near the first and second sidewalls, respectively, and defining an auger axis intersecting the first and second sidewalls, wherein the auger shaft is configured to rotate, relative to the auger housing, about the auger axis; and a flight attached to the auger shaft, wherein the first and second skids are height-adjustable relative to the auger housing and are configured to support the auger housing upon the ground surface such that a surface of revolution defined by the flight is spaced-apart from the ground surface, during normal snowthrower operation, by an auger offset distance to create an auger clearance zone between the flight and the ground surface; and a resilient scraper forming a cantilever having an upper end connected to the lower edge of the rear wall, the resilient scraper extending downwardly toward the ground surface and into the auger clearance zone to terminate at a lower end that is spaced-apart from the ground surface.

2. The snowthrower of claim 1, wherein the resilient scraper comprises two or more separate scraper segments, wherein each segment extends along a different transverse portion of the rear wall.

3. The snowthrower of claim 1, wherein the resilient scraper comprises a polyurethane sheet.

4. The snowthrower of claim 3, wherein in the polyurethane sheet comprises material of a durometer of 70 to 90 Shore A.

5. The snowthrower of claim 1, wherein the resilient scraper comprises a sheet having a thickness of 0.2 to 0.5 inches.

6. A self-propelled snowthrower vehicle comprising:

a chassis comprising a front end and a rear end, the rear end spaced-apart from the front end along a longitudinal axis of the vehicle, the chassis further comprising a control tower extending upwardly at or near the rear end;

ground-engaging members adapted to support a portion of the chassis upon a ground surface;

a support platform attached to the chassis at or near the rear end and configured to support an operator; and a snowthrower attached to the chassis, the snowthrower comprising:

an auger housing comprising spaced-apart first and second sidewalls connected to one another by a rear wall to define a front-facing collection opening, the rear wall comprising a lower edge, wherein the auger housing is supported upon a ground surface at least partially by first and second height-adjustable skids attached to the first and second sidewalls, respectively;

an auger positioned within the auger housing between the collection opening and the rear wall, wherein the first and second skids are configured to support the auger housing upon the ground surface such that a surface of revolution defined by the auger is spaced-apart from the ground surface, during normal snowthrower operation, by an auger offset distance to create an auger clearance zone between the auger and the ground surface; and a resilient scraper attached to the lower edge of the rear wall, the resilient scraper extending downwardly from the rear wall toward the ground surface and into the auger clearance zone to terminate at a lower end that is spaced-apart from the ground surface.

* * * * *